US006577234B1

(12) United States Patent
Dohrmann

(10) Patent No.: US 6,577,234 B1
(45) Date of Patent: Jun. 10, 2003

(54) SECURITY SYSTEM

(75) Inventor: Anthony Dohrmann, Huntsville, AL (US)

(73) Assignee: Laser Shield Systems, Inc., Carlsbad, CA (US)

( * ) Notice: Subject to any disclaimer, the term of this patent is extended or adjusted under 35 U.S.C. 154(b) by 0 days.

(21) Appl. No.: 09/616,155

(22) Filed: Jul. 14, 2000

Related U.S. Application Data

(63) Continuation-in-part of application No. 09/432,669, filed on Nov. 2, 1999, now Pat. No. 6,288,642.

(51) Int. Cl.[7] ..... G08B 21/00

(52) U.S. Cl. ..... 340/540; 340/541; 340/550; 455/573

(58) Field of Search ..... 340/540, 541, 340/532, 550, 552, 565; 455/404, 573

(56) References Cited

U.S. PATENT DOCUMENTS 3,855,574 A * 12/1974 Welty ..... 340/309.15
4,511,886 A * 4/1985 Rodriguez ..... 340/534
4,943,799 A 7/1990 Papineau
5,440,292 A * 8/1995 Bedrosian ..... 340/567
5,463,595 A * 10/1995 Rodhall et al. ..... 367/93
5,621,385 A 4/1997 Carney
5,629,687 A * 5/1997 Sutton et al. ..... 340/825.37
5,640,141 A 6/1997 Myllymaki
5,777,551 A 7/1998 Hess
5,805,064 A * 9/1998 Yorkey ..... 340/550
5,808,547 A 9/1998 Carney
5,850,180 A * 12/1998 Hess ..... 340/541
5,877,684 A * 3/1999 Lu ..... 340/521
6,192,236 B1 * 2/2001 Irvin ..... 455/420

* cited by examiner

*Primary Examiner*—Daniel J. Wu
*Assistant Examiner*—Son Tang
(74) *Attorney, Agent, or Firm*—Jones, Waldo, Holbrook & McDonough; Michael W. Starkweather

(57) ABSTRACT

A security system comprising discrete detector units engaged together in data communication and each for detecting danger and for causing an emitting of an alerting stimulus in response thereto.

12 Claims, 6 Drawing Sheets

SECURITY SYSTEM

CROSS-REFERENCE TO RELATED APPLICATION

This application is a continuation-in-part of application Ser. No. 09/432,669, entitled "Self-Contained Security System", filed Nov. 2, 1999 now U.S. Pat. No. 6,288,642.

FIELD OF THE INVENTION

This invention relates to methods and apparatus for providing security in homes, apartments, hotel rooms and other dwelling spaces and business establishments.

BACKGROUND OF THE INVENTION

Most security systems use audible and/or visual stimulus as the means for warning of danger. Given the dangers or threats against safety or security posed by fire, gas leaks, unsafe carbon monoxide levels and other catastrophic events and unwanted intruders such as thieves, burglars and vandals, the art is replete with dedicated alarm or security systems for use in homes and businesses. These security systems are normally difficult to install and considerably expensive. To meet consumer needs, skilled artisans have devoted considerable effort toward portable self-contained security systems, which give consumers a less expensive and convenient alternative to the more expensive dedicated security systems. However, known self-contained security systems are difficult to construct and suffer from structural and organizational shortcomings that impede efficient operation and installation throughout a structure having many separate rooms.

Thus, there is a need for a new and improved security system that is portable, easy to use, personalized, inexpensive and suitable for use in apartments, homes, businesses, boats, trailers, motor homes, hotels and other structures lacking a dedicated security system.

SUMMARY OF THE INVENTION

The above problems and others are at least partially solved and the above purposes and others realized in a new and improved security system comprising a main unit having programmable apparatus movable between an active or "ARMED" mode for emitting an alerting stimulus in response to the presence of danger, an inactive or "DISARMED" mode, a "BYPASS" mode and a "TROUBLED" mode indicating irregular operation. An indicator indicates whether the apparatus is in the "ARMED", "DISARMED" and "TROUBLED" mode. The alerting stimulus comprises one or more of a visual stimulus provided from a lamp and/or a segmented display, an audible stimulus provided from a horn or speaker, and the activation of a signal apparatus for alerting emergency and/or monitoring personnel over a communication pathway. The apparatus includes a detector for detecting danger whether posed from an intruder, fire, gas or carbon monoxide buildup, or other form of danger. The system may further include one or more satellite units coupled in signal communication with the main unit. Each satellite unit include similar structure to that of the main unit, and in response to sensing danger, sends a signal to the main unit which causes the main unit to emit one or more of the alerting stimuli.

BRIEF DESCRIPTION OF THE DRAWINGS

The foregoing and further and more specific objects and advantages of the invention will become readily apparent to those skilled in the art from the following detailed description taken in conjunction with the drawings in which.

DETAILED DESCRIPTION OF A PREFERRED EMBODIMENT

The present invention is comprised of a personalized security system and of associated methods for providing personalized security. The invention is easy to use, portable and can be adapted as a network of nodes or stations that operate together in harmony for facilitating security service in and out of the home and even at the same time. The network is programmable and user friendly, and the nodes incorporate data structures or systems for facilitating communication therebetween and with one or more central or remote monitoring stations. With the proliferation of portable communication devices and wireless communication technology, the invention contemplates the integration of pagers, wireless telephones, hand-held and portable computing devices and other devices capable sending and receiving data over one or more communication pathways. Given the flexibility and adaptability of the invention as will be thoroughly explained in this specification, the invention may also be incorporated with a networked computer environment, such as a local area network (LAN) or the Internet.

Figure 2:
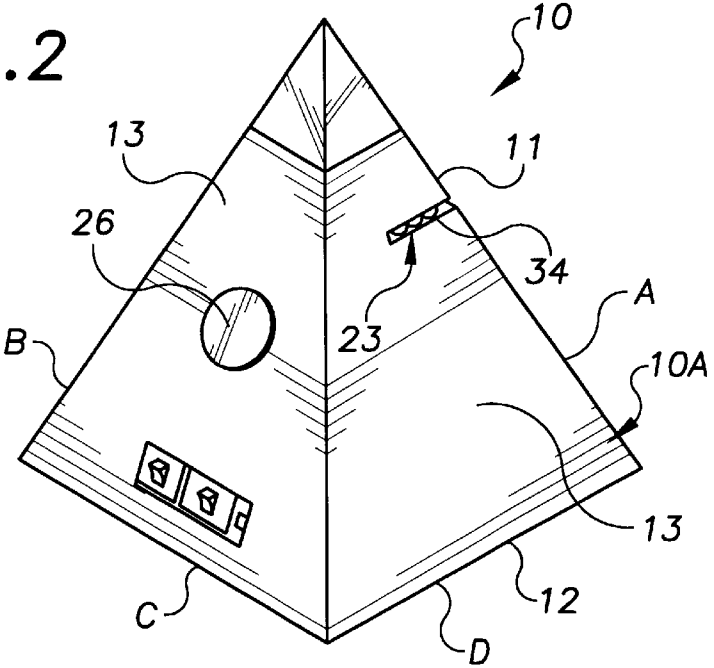
FIG. 2 is another perspective view of the security system of FIG. 1.
Figure 1:
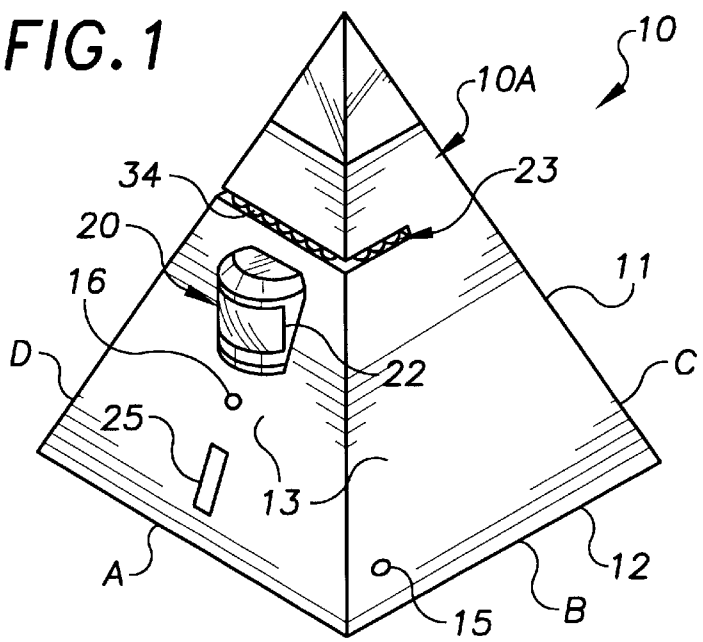
FIG. 1 is a perspective view of a security system.

Turning to the drawings, FIGS. 1 and 2 illustrate perspective views of a security system 10 for detecting danger and for emitting an alerting stimulus in response to the presence of danger. In the presence of danger, it is to be understood that system 10 is capable of detecting the danger. System 10 is discrete, self-contained and is portable and well suited for use in structures such as houses, apartments, businesses, boats, trailers, motor- and mobile-homes and other structures lacking dedicated security systems, and by frequent travelers. The term "danger" as used in this disclosure is intended to comprise any event and/or individual(s) that pose a threat to property and/or personal safety such as a criminal, a burglar, a thief or an unwanted intruder, fire, unsafe or unwanted levels of gas or carbon monoxide, water, etc.

System 10 is comprised of a main, mother or central unit 10A having apparatus 20 (FIG. 1) for detecting danger and for emitting an alerting stimulus in response thereto. Apparatus 20 is contained substantially by a housing 11. In this embodiment, housing 11 is the shape of a substantial pyramid, having a polygonal base 12 and triangular faces 13 that meet at a common point 14. Housing 11 is constructed of any substantially rigid material or materials such as, for instance, fiberglass, strong plastic, a metal or metallic composite material, etc. The pyramid shape makes housing 11 very strong and substantially unbreakable by intruders. Unit 10A normally rests with base 12 against surface and common point 14 projects upwardly. Should an intruder attempt to destroy unit 10A, his first approach will likely be to stomp or hit housing 11 with an impacting force, such as with one of his feet or hands. Because common point 14 is pointy, it is envisioned that any damage an intruder attempts to inflict upon unit 10A will result in considerable pain to the hands and/or feet of the intruder. Without a relatively easy way to deliver damaging force to unit 10A, it is envisioned that the intruder will become frustrated and leave the premises.

Figure 6:
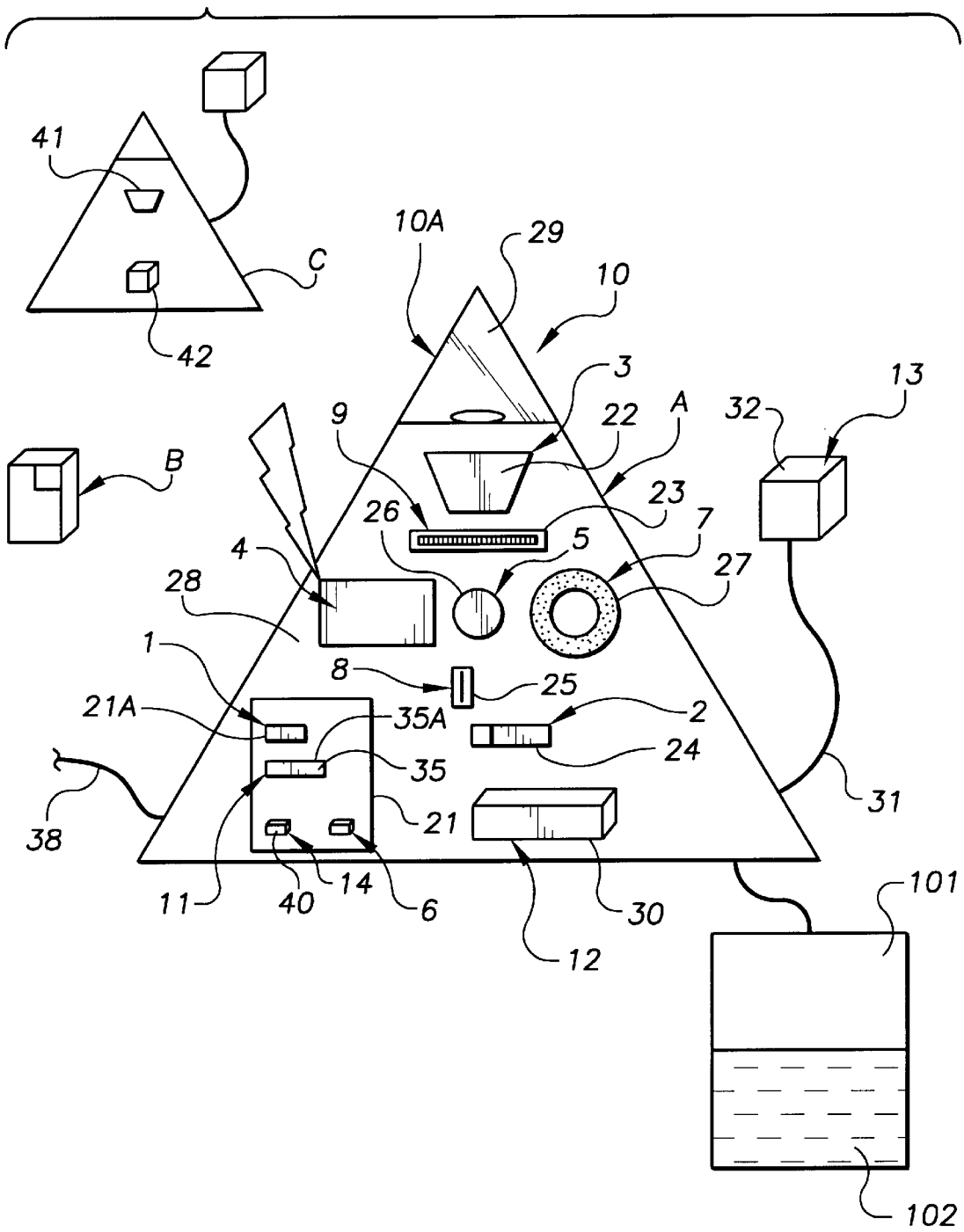
FIG. 6 is a schematic representation of the security system of FIG. 1 and a satellite element.

Turning to FIG. 6, shown is a schematic representation of system 10 including apparatus 20. Apparatus 20 is comprised of a variety of components including a controller 21, a detector 22, a segmented display 23, a switch 24 for turning apparatus 20 "ON" and "OFF" and for doing other things as will be explained, a display 25 and a monitor 101 and an associated input device or apparatus or controls 102, a panic switch 26, a horn or speaker 27, a receiver/transmitter 28, a lamp 29, a camera 100 (shown only in FIG. 1), a discrete power source 30 and a power cord 31 engagable to a fixed power source 32 such as a wall transformer. Display 25 is functional for displaying the operational data and parameters of system 10 and one or more menus and for displaying images. By using input device 102, a user can interact with the menus for entering program commands, for setting operational parameters, etc. Input apparatus 102 may comprise a keypad, a pointer, a display that is responsive to direct physical stimulus, a voice response system, etc. Lamp 29 is located at and defines the common point 14 of housing 11 and it may be positioned at other locations. Controller 21 is programmable and contains a micro-controller or processing apparatus 21A that is run by software. Processing apparatus 21A controls the operation of apparatus 20, the interaction between the various components of apparatus 20, and a processing infrastructure that is adapted, configured, and arranged for facilitating communications capabilities, with a data propagating structure for causing a data transfer with associated satellite units and with a searching and locating data structure. The data propagating structure, satellite units and the searching and locating data structure will be discussed later in this specification. Electrical power may be provided to controller 21 from the fixed power source 32 via power cord 31, and from discrete power source 30. Discrete power source 30 is a rechargeable nickel-cadmium battery or other form of discrete, rechargeable power source or non-rechargeable power source. Controller 21 is coupled electrically to discrete power source 30, power cord 31 and to components 22–29 in a conventional manner. Power cord 31 is also coupled electrically to discrete power source 30, and provides discrete power source 30 with charging electrical energy when plugged into fixed power source 32. Electrical power is channeled to the various components of apparatus 20 through controller 21 and this is not essential.

Figure 5:
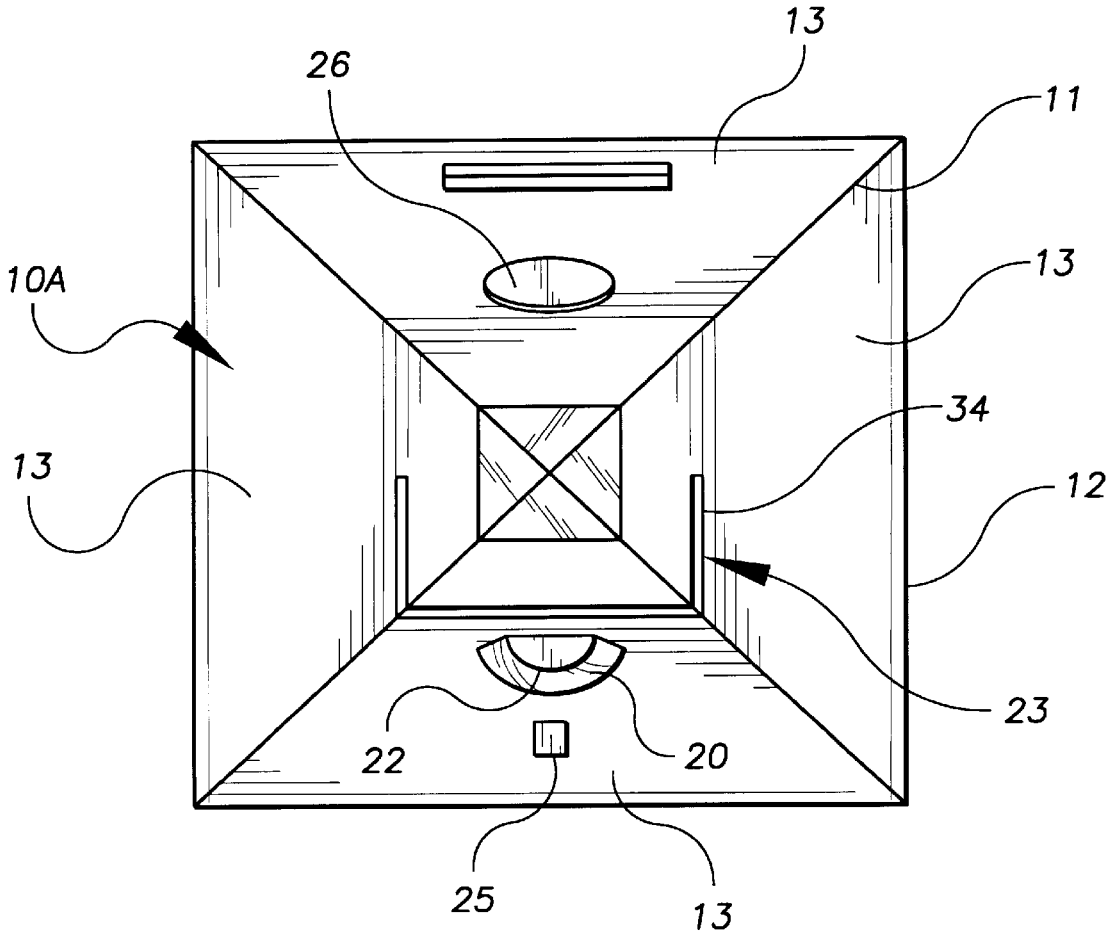
FIG. 5 is a top plan view of the security system of FIG. 1.

Turning back to FIG. 1, detector 22 is supported by housing 11 and is substantially exposed through one of faces 13, which allows it to sense danger such as in the form of motion from an intruder, heat from fire, noise from broken glass and other sounds, and/or gas, carbon monoxide, radon, moisture, water, etc. Consistent with the spirit of the invention, detector 22 may comprise a motion detector such as a passive infrared motion detector, a heat detector, a noise detector, a radon detector, a moisture or water detector, a gas or carbon monoxide detector and any combination thereof among potential others. Unit 10A may be equipped with a universal detector or sensor port 15 (FIG. 1) that is adapted and arranged for accepting each of a plurality of modular or discrete detectors, which allows a user to select and employ any desired one of the discrete detectors depending on specific needs or desires. When fitted into the universal detector port, which is equipped with a universal electrical coupling for facilitating an electrical and signal interconnection with each of the modular or discrete detectors, the chosen detector works in accordance with the teachings of the invention. The discrete detector may be configured as a multi-tasking unit for detecting a plurality of dangers, whether at the same time or at different times. Regarding FIG. 3, segmented display 23 is comprised of a plurality of lights 33 arranged in substantially linear series. Lights 33 are supported by housing 11 and are exposed through a groove or opening 34 (FIG. 5) formed in three faces 13 of housing 11 and they may be exposed through less or more.

Figure 4:
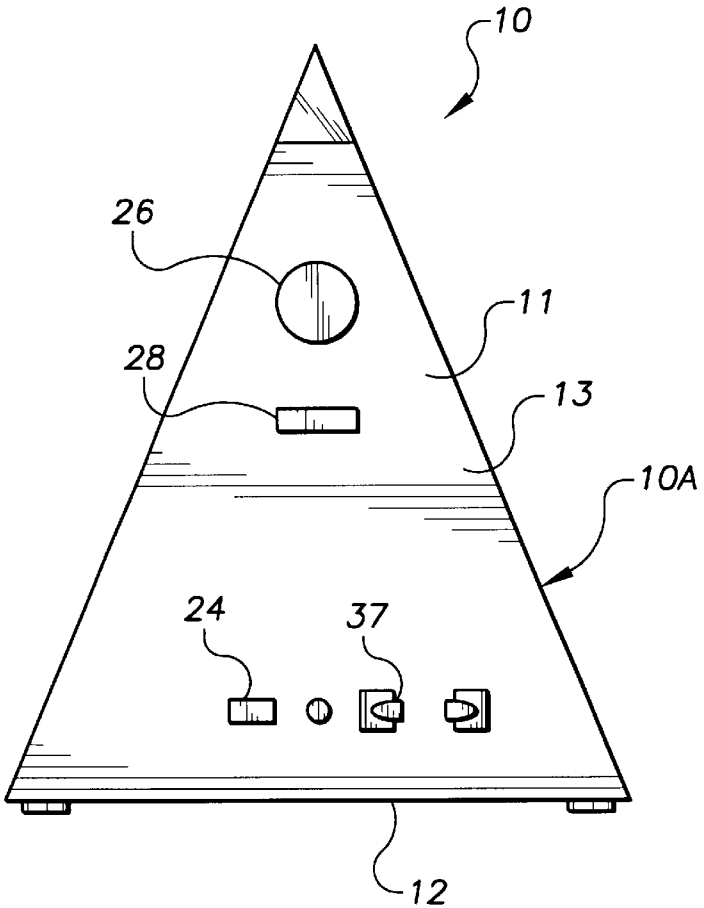
FIG. 4 is a rear elevational view of the security system of FIG. 1.
Figure 3:
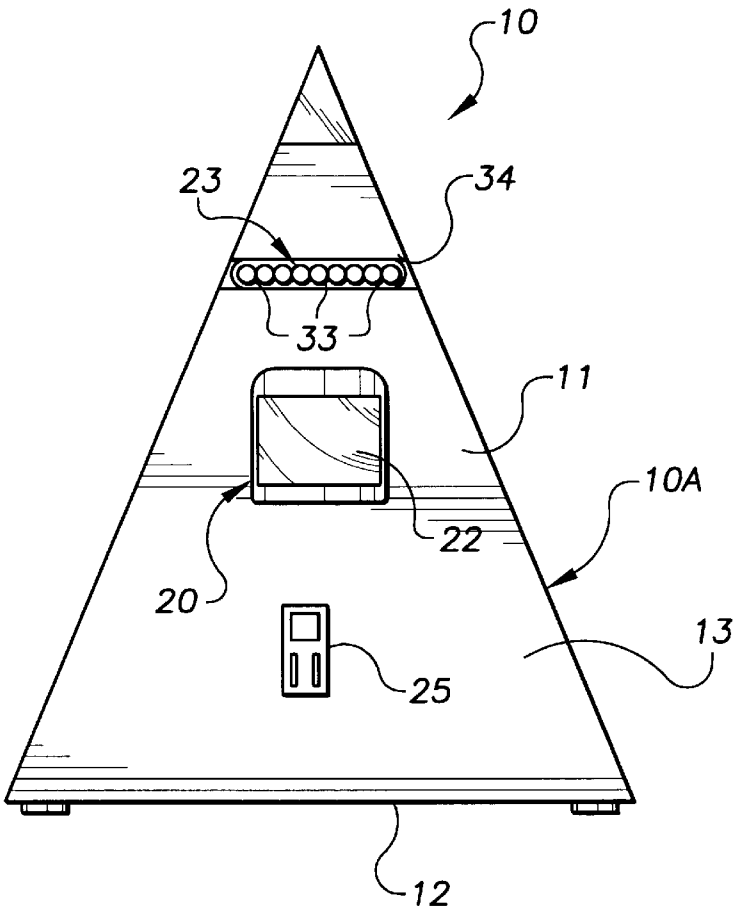
FIG. 3 is a front elevational view of the security system of FIG. 1.

Display 25 and switch 24 are also supported by housing 11 and are each exposed (FIGS. 3 and 4, respectively). Switch 24 is conveniently located and may be engaged and actuated for moving apparatus 20 into an "ARMED" condition or mode, an inactive or "DISARMED" condition or mode, a "BYPASS" condition or mode, an "AWAKE" condition or mode and a "SLEEP" condition or mode. In the "ARMED" condition, apparatus 20 is active for sensing danger and for emitting an alerting stimulus in response thereto. In the "DISARMED" condition, apparatus 20 is inactive. In the "BYPASS" mode, the "ARMED" condition of apparatus 20 is disabled, but it does not render apparatus 20 inactive, but only prevents apparatus 20 from emitting an alerting stimulus in response to sensing or detecting danger, which it still does in the "BYPASS" mode. The "BYPASS" mode is convenient, because it allows an individual to be in the same room as unit 10A without it emitting an alerting stimulus. When the user leaves the room or wishes to place apparatus 20 into the "ARMED" condition, the user need only actuate switch 24 to move apparatus 20 from the "BYPASS" mode to the "ARMED" mode. In the event a user feels threatened from danger, the user may simply engage and actuate panic switch 26, which will automatically cause apparatus 20 to emit the programmed alerting stimulus. In response to actuating panic switch 26, apparatus 20 is adapted and arranged to emit the programmed alerting stimulus in each of the "ARMED", "DISARMED" and "BYPASS" modes.

The "SLEEP" condition is the low power mode, which provides a very low amount of power to the electrical components of unit 10A. The "SLEEP" mode is used primarily for shipping. From the "AWAKE" mode, which is a mode that places unit 10A into a standby state, unit 10A may be moved into any other operational mode.

Display 25 is an illuminated display such as a display having a substantial flat form factor, a liquid crystal display, an LED display or other suitable illuminated display, and displays information such as whether apparatus 20 is in the "ARMED" condition by displaying "A", the "DISARMED" condition by displaying "D", the "BYPASS" condition by displaying "B", the "SLEEP" mode by displaying an "S", and the "AWAKE" mode by displaying "AK". As long as discrete power source 30 can provide power and unit 10A is ON, controller 21 is always energized and actuates display 25 for showing the "A" or the "D" or the "S" regardless of whether power cord 31 is plugged into a fixed power source. Display 25 is optional, and a light, such as LED 16 FIG. 1, may be provide to illuminate in different colors or in different illuminated state for indicating the various modes of operation ad described herein in lieu of display 25.

Unit 10A has a relatively small, compact countenance and may be situated anywhere in a room a user desires. After plugging power cord 31 into a fixed power source, such as fixed power source 32, the user may move or actuate switch 24 to turn unit 10A "ON" and place apparatus 20 into the "ARMED" condition. Normally, system 10 is activated when the owner or occupant is leaving the given premises or, perhaps, going to bed. Upon arming apparatus 20, horn 27 will chirp a given number of times, such as seven or more or less times, and segmented display 23 will flash and display 25 will show the "D". This defines an "Exit Delay" mode of apparatus 20, during which time a user is given time to leave the premises prior to system 10 arming itself. After a predetermined period of time has elapsed, such as ten to fifteen seconds, apparatus 20 will move out of the "Exit Delay" mode and into the "ARMED" mode, at which time horn 27 chirps a given number of times, such as two or more or less times, display 25 displays the "A" and segmented display 23 ceases its flashing.

In the "ARMED" mode, apparatus 20 is sensitive to danger, whether one or many, and emits an alerting stimulus when it detects danger. Controller 21 initiates the alerting stimulus in response to the detection of danger by detector 22. The alerting stimulus may comprise an illumination of lamp 29, an activation of horn 27 to emit a loud audible stimulus or alarm, an illumination of segmented display 23 and/or an activation of a communications apparatus 35 for alerting emergency or monitoring personnel over a communication pathway and/or for activating another component or components of system 10 as will be discussed later in this specification. The communication pathway can comprise any of a potentially vast array of wired and/or wireless telephony or communication pathways including modem, a cable communication pathway, a communication pathway facilitated over a local or central computer network, such as a local area network (LAN) or the Internet, a radio frequency communication pathway, a cable television communication pathway and any combination thereof among potentially many others. In terms of the Internet, communication may be facilitated through a portal, i.e., a publicly accessible web site, using an encrypted or non-encrypted communications protocol. Controller 21 may be programmed for emitting any one or more or each of the alerting stimulus. Communications apparatus 35 is considered part of apparatus 20, and comprises a programmable communication device 35A that upon activation, establishes a communications link with a central monitoring station over one or more communication pathways. When the central monitoring station receives the call, it alerts personnel stationed at the central monitoring station to a potential emergency situation and the location from which the call is being placed. In response to being alerted to the emergency situation, the monitoring personnel can then either dispatch fire, police and/or paramedic emergency personnel or alert the fire, police and/or paramedic emergency personnel to the emergency situation.

Camera 100 (FIG. 1) is an important feature of the invention, as it may be actuated from a remote location via one or more signal or communication pathways facilitated by communications apparatus 35. When emergency personnel are alerted to a potential emergency situation by system 10, they may control, actuate and use camera 100 for seeing into the dwelling structure for visually identifying the state of the alert. Clearly, the central monitoring station is equipped with a monitor is display devices for allowing the emergency or monitoring personnel to view images taken by camera 100. With this capability, the emergency personnel are given the ability to dispatch or alert the appropriate response team. Camera 100 may be a digital or analog video camera or a still photograph camera, and is preferably equipped with a wide-angle lens for facilitating a wide field of view, and a plurality of cameras may be employed. Camera 100 is shown supported by and extending through housing 11, and it may be a separate, discrete, and/or remote component if desired. One or more of the other satellite components of the invention, as will be later. in this specification, may also be equipped or provided with a camera and all of the other structural components of unit 10A as may be desired. To allow a user to view images taken by the camera or cameras of any of the satellite units and the main unit of system 10, each or any of the satellite units, including main unit 10A, may be equipped with a monitor or display and associated controls, like monitor 101 and controls 102 of unit 10A. Monitor 102, like all monitors of this disclosure, comprises an illuminated display such as a display having a substantial flat form factor, a liquid crystal display, an LED display or other suitable illuminated display.

Regarding FIG. 4, shown is a communications port 37. Port 37 is carried by housing 11, and is adapted and arranged as a gateway for establishing or facilitating communications links, sending and receiving communication signals, and for sending and receiving communication signals over any one or more of the communication pathways disclosed and previously defined in this specification. Port 37 is interfaced with camera 100, apparatus 20 and the associated display and/or monitor, and each or one or more of the other satellite units of system 10 may also be provided with a similar port. In this spirit, port 37 is further adapted and arranged to provide a wireless coupling to one or more communication pathways and/or to provide a direct physical coupling to a communication cable or line, such as a phone or modem line 38 as substantially shown in FIG. 6.

To further indicate the "ARMED", "DISARMED" and "BYPASS" conditions, especially to people having difficulty hearing or seeing, controller 21 may be programmed to activate segmented display 23 into one of a plurality of different illuminated conditions, each illuminated condition for indicating one of the "ARMED", "DISARMED" and "BYPASS" conditions. The illuminated conditions may comprise a strobing condition, a rolling condition, a steady condition, etc. In addition to the "ARMED", "DISARMED" and "BYPASS" conditions, apparatus 20 may also be moved into a "TROUBLED" condition. During normal use, system 10 should always be coupled to a fixed power source. In the event power cord 31 becomes disengaged from fixed power source 32, the wireless or hard telecommunication pathway of communications apparatus 35 becomes severed, and/or in the event the power remaining in discrete power source falls below a predetermined threshold, which threshold may be programmed into controller 21, controller 21 may be programmed to actuate horn 27 for emitting a loud audible siren or stimulus and/or segmented display 23 to indicate one or both of these events, each of which comprises a "TROUBLED CONDITION". Plugging power cord 31 into a fixed power source, replacing discrete power source 30 or recharging discrete power source 30 above the predetermined threshold each solve the "TROUBLED CONDITION". Once the troubled condition is remedied, controller 21 deactivates horn 27 and/or segmented display 23.

In addition to placing apparatus 20 into the "ARMED", "DISARMED" and "BYPASS" conditions, switch 24 is also for turning lamp 29 "ON" and "OFF" and this may be done with another switch if desired. When turned "ON", lamp 29 illuminates. In this illuminated state, unit 10A may be held and used as a flashlight. Additionally, in the event power cord 31 becomes disengaged from fixed power source 32, either accidentally or by an intruder, discrete power source 30 will continue to provide power to apparatus 20. However, in response to the disengagement of power cord 31 from the fixed power source 32 such that the only power provided comes from discrete power source 30, controller 21 may be programmed to actuate and illuminate lamp 29. Power fail circuitry 40 of controller 21 provides this function. Accordingly, system 10 can be immediately and easily unplugged to be used as an emergency flashlight to illuminate safe exits. Upon re-engaging power cord 31 to fixed power source 32, controller 21 is normally programmed to deactivate lamp 29. Lamp 29 is contained in a transparent housing which defines that portion of housing 11 leading to common point 14, and is preferably comprised of a halogen light bulb or other high intensity fixture suitable for providing a bright illumination.

Regarding FIG. 6, receiver/transmitter 28 facilitates communication links with the other satellite units over any one or more of the communications pathways as defined herein, including, for instance, broadband or radio frequency signal communications links. To increase operational range, system 10 further includes a satellite unit 41 and more can be provided as previously intimated, but only one is shown now for the purpose of illustration. Satellite unit 41 is for placement at a location away or remote from unit 10A, such as in another room of a dwelling structure, and includes substantially the same structural components as unit 10A, details of which will not be again discussed as it would be unnecessarily repetitive. Unit 41 includes a receiver/transmitter 42 for facilitating a communication and/or data link with unit 10A over any one or more of the communication pathways previously discussed and defined in this specification and with other satellite units. Receiver/transmitter 42 is adapted and arranged to be coupled to receiver/transmitter 28 in signal and data communication. In the event satellite unit 41 detects danger, its controller sends a signal from receiver/transmitter 42 to receiver/transmitter 28 of unit 10A. In response to receiving this signal, controller 21 initiates the alerting stimulus. One or more satellites units, including unit 41, may be coupled to unit 10A in data and signal communication over a wireless or wired communication pathway.

Figure 7:
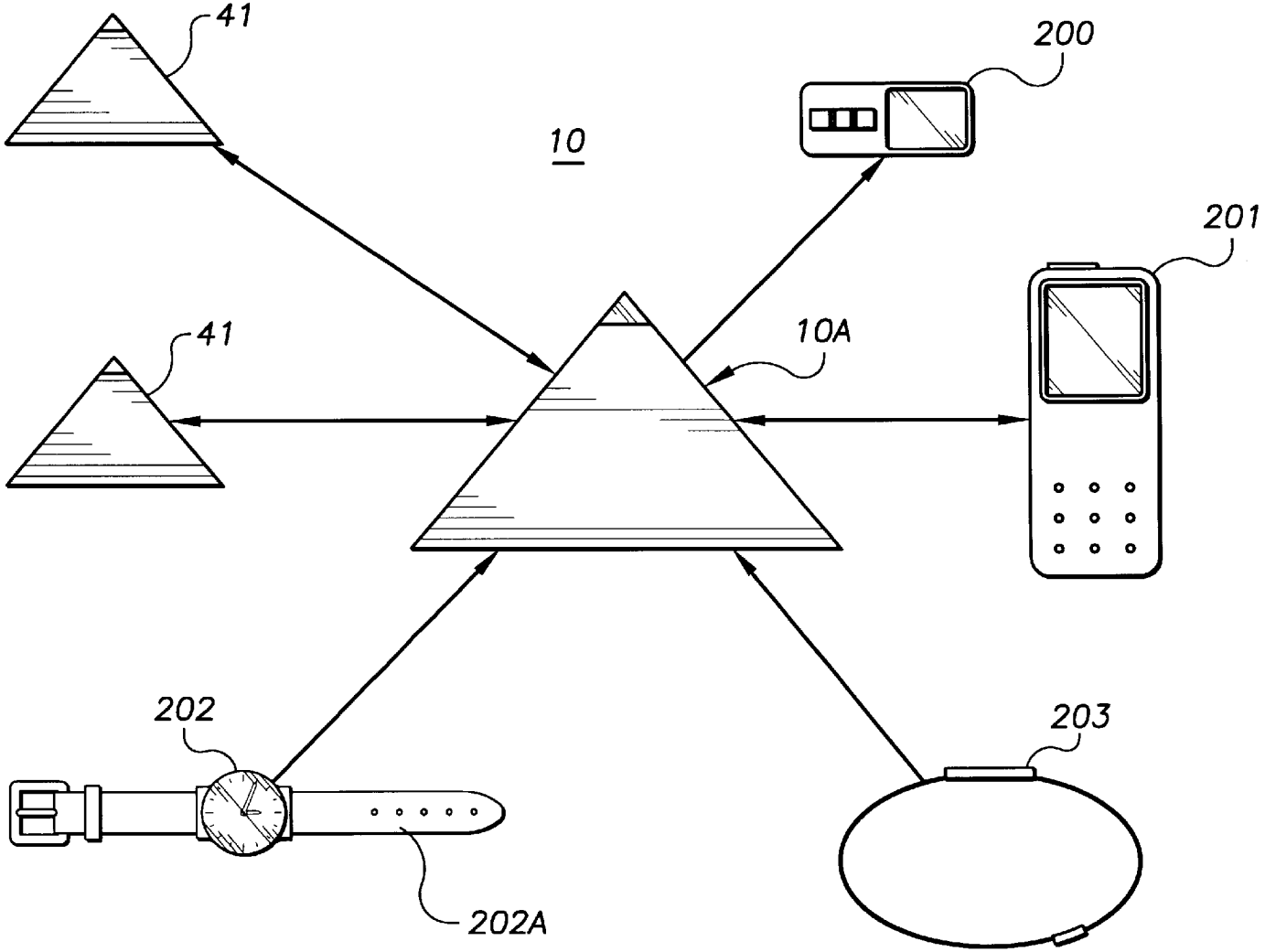
FIG. 7 is a schematic representation of the security system of FIG. 1 and a plurality of satellite elements.

A potentially vast number of satellite units may be incorporated into system 10, and they may take on many forms or incorporated into a potentially vast number of electronic devices that many people use on a daily basis such as pagers, desk-top or lap-top computers, cell- or wireless telephones or individual subscriber units (ISUs) of a wireless communication network, portable or hand-held computers and other devices capable of accessing the Internet, wrist and pocket watches, etc. However, the various structural components of each satellite unit as discussed herein remains the same. As a matter of example, FIG. 7 illustrates system 10 including unit 10A, two satellite units 41 and more may be provided, and satellite units incorporated as or into or with a pager 200, a wireless telephone 201, a watch 202 and a collar 203 among potentially many other devices. Collar 203 may be fitted onto a child or pet, and may be equipped with a proximity detector that is designed to cause unit 10A to emit an alerting stimulus when it passes beyond a predetermined or preprogrammed range. Watch 202 is carried by a strap 202A, and strap 202A and collar 203 have engagement structure or couplings, like clip or buckle structure, engagable in a wrapped or coupled condition for engagement to a person or animal in an encircling condition. Collar 203 and strap 202A are preferably equipped with electronic couplings operative for causing a signal to be sent to unit 10A to cause unit 10A to emit an alerting stimulus when either one of their couplings become disengaged. When the alerting stimulus becomes manifest, it is envisioned that the charges of the child or pet will become alerted to a possible problem.

In a typical scenario, system 10 will include unit 10A and one or more satellite units such as units 41, one or more pagers 200, one or more phones 201, etc. For system 10 to operate harmoniously, the various elements of system 10 are coded with a signature data structure so that the various elements are essentially aware of the existence of the other components, or that at least unit 10A is essentially aware of the other satellite units. In this regard, when unit 10A is "ON", the searching and locating data structure of processing apparatus 21A initializes and initiates a signature search for any active satellites. The term "active" means only that the unit is "ON" or energized. When turned "ON", the controller of each of the satellites are configured and arranged to emit a signature signal, which processing apparatus 21A of unit 10A is capable of searching for and locating or detecting over any one of the communication pathways previously defined in this specification. When unit 10A has located the satellite units, it then knows that they are there and part of system 10. After unit 10A has located each satellite, data-propagating structure of processing apparatus 21A of unit 10A uploads its operating data platform to the other active satellites, which the satellites store into their memory. This ensures that the operational parameters between unit 10A and its associated satellites are consistent. All programming and data entry normally takes place at unit 10A, which programming and data propagates throughout the satellite units by way of the data propagating structure of processing apparatus 21A of unit 10A. It should be understood that the processing and control apparatus of unit 10A and all of the satellite units include memory. The data propagating structure of processing apparatus 21A of unit 10A may be programmed for periodically or continuously updating the programming and data with the satellites.

Figure 8:
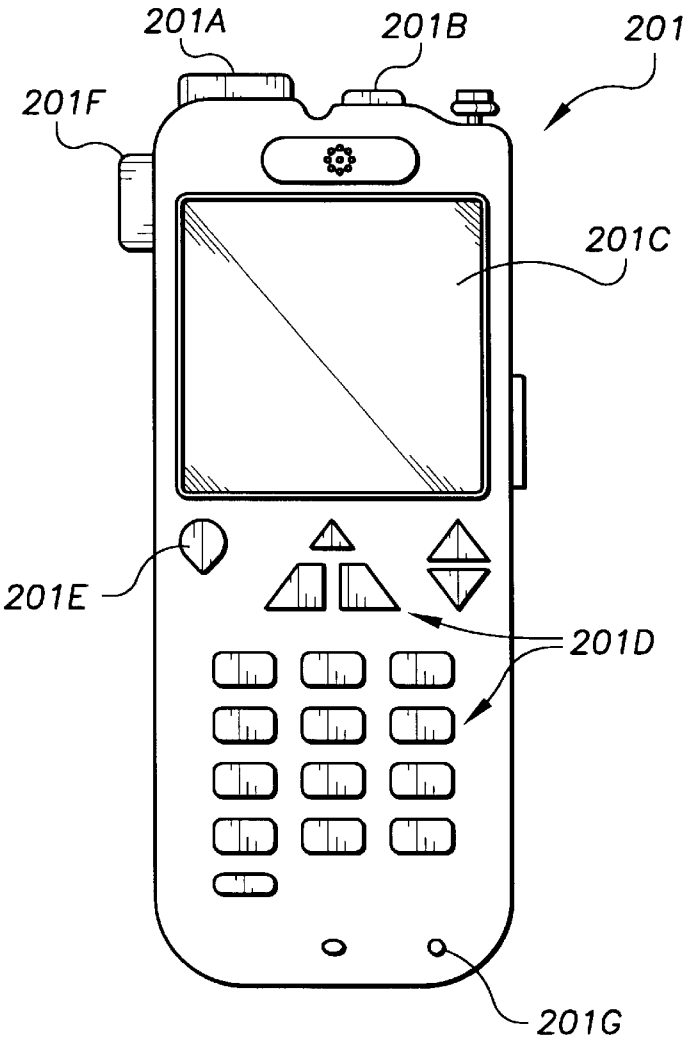
FIG. 8 is a general representation of a satellite unit of the invention.

Because each satellite is substantially similar in structure and function to unit 10A, with the exception of the shape of housing 11 in some instances, each satellite unit is equipped with an input device and associated display and a processing infrastructure that is adapted, configured, and arranged for facilitating communications capabilities, a data-propagating structure for causing a data transfer with associated satellite units and a searching and locating data structure. By entering programming commands into unit 10A with its input device 102, a user may select any one of the other satellite units to function as the main unit. As an alternative, a user may call into and access controller 21 via communications apparatus 35 of unit 10A over a wired and/or wireless telecommunications link and enter programming commands into controller 21 of unit 10A. The user may dial in over a conventional telephone, a wireless telephone or with a computer over the Internet through a publicly accessible web site, and enter commands into unit 10A with the computer or the keypad of the telephone. Appropriate password protections may be used for preventing unauthorized individuals from accessing unit 10A. In another embodiment, system 10 may be equipped with a voice-interactive telephony system for allowing a user to enter programming commands by voice response. As previously discussed in this specification, any one of the satellite units can be equipped with a monitor and with the ability to actuate camera 100 for displaying images taken by camera 100. As a matter of example, FIG. 8 is an enlarged view of phone 201 (ISU) of FIG. 7. In FIG. 8, phone 201 is shown equipped with a camera 201A, a detector 201B, a display/monitor 201C and an associated input device 201D, which in this embodiment is a keypad, a panic switch 201E a light 201F having a high intensity light bulb and which is useful as a flashlight as previously disclosed, and a universal detector or sensor port 201G.

Figure 9:
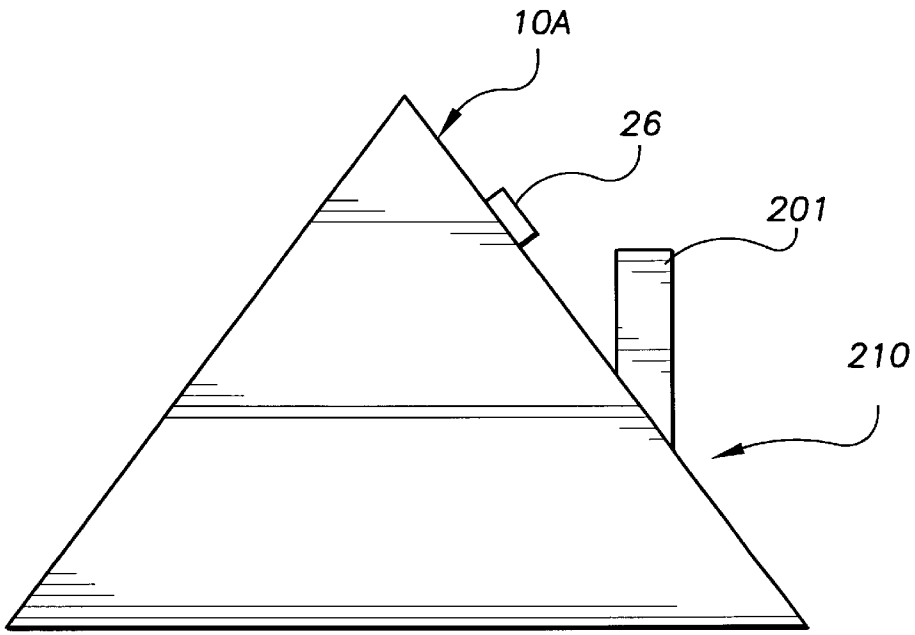
FIG. 9 is a view showing the satellite unit of FIG. 8 as it would appear situated in a docking station of the security system of FIG. 1.

The invention has been described above with reference to one or more preferred embodiments. However, those skilled in the art will recognize that changes and modifications may be made in the described embodiments without departing from the nature and scope of the invention. For instance FIG. 9 illustrates phone 201 of FIG. 7 as it would appear situated into a docking station 210 formed into and through housing 11 of unit 10A. Docking station 210 is equipped with couplings for providing recharging electrical energy to the battery of phone 201 and for facilitating a data transfer between phone 210 and unit 10A as provided by the data propagating structure discussed previously in this specification. Docking station 210 includes a locking mechanism for locking phone 201 in place, such that it can only be removed by a key, combination, etc. Also, phone 201 (FIG. 7) may be configured with a manual locator feature. In this regard, one of the keys of input device 201D may be configured as a "LOCATOR" button or key that when pressed brings up a menu on display 201C. By using input device 201D, a user may interact with a menu for communicating with unit 10A and letting unit 10A know where phone 201 is located. By interacting with the menu, the user can, for instance, enter the state, city and address at which he is located, whether he is at an apartment, a hotel and even the hotel room or apartment number, a house, a boat, a bus, etc. In response to actuating the "LOCATOR" button, phone 201 may be configured to request the user to input a security code prior to allowing the user access to the manual locator feature of the invention. The security code may comprise a numbered and/or lettered code or perhaps a voice response password.

Also, any of the satellite units of the invention, including main unit 10A, may be configured with a signal strength indicator including an associated display for showing the signal strength with some sort of sensible indicia or the like. The display may comprise an LED or liquid crystal display or other suitable display. To find or otherwise provide the maximum or desired signal strength between a given satellite unit an another satellite unit or the main unit 10A, the user may move the given satellite unit selectively unit the display shows the maximum or desired signal strength. This can be especially important when one or more satellite units are worn or otherwise carried by a child. In this vein, should an event cause the satellite unit carried or otherwise worn by the child cause an initiation of a alerting stimulus, the parent or charge of the child can use another satellite unit and even the main unit and then move it in various directions until the signal strength is strongest, which would indicate the general direction of the child's satellite unit. This, of course, would give the parent or charge of the child a sense of where the child is located so that he or she may be easily found.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same the invention claimed is:

1. A security system, comprising:

a) at least one satellite unit coupled in signal communication to a main unit, the main unit further comprising a housing, the housing being substantially in the form of a pyramid with a base, and an apparatus for emitting an alerting stimulus in response to a signal received from the satellite unit indicating the presence of a security threat;

b) at least one controller contained by the at least one satellite unit and the main unit;

c) a lamp positioned on the at least one satellite unit and the main unit, such that there is no portion of the security system above the lamp obstructing the lamp's illumination;

d) a discrete power source contained by the at least one satellite unit and the main unit for providing power to the controller and the lamp;

e) a panic switch located on a side of the pyramid, for causing the apparatus to emit the alerting stimulus upon actuation of the panic switch;

f) a detector, for detecting the presence of at least one security threat, located on the side of the pyramid, oriented in an approximately vertical position, forming an angle with the side of the pyramid upon which the detector is placed, the detector and the panic switch being located substantially on opposite location on the pyramid sides;

g) a cell phone docking station, mounted to the side of the pyramid, for recharging electrical energy to a cell phone; and h) a cell phone locking mechanism, located at the cell phone docking station, designed to lock the cell phone in place while being recharged.

2. The security system of claim 1, further comprising:

a segmented light fixture including a plurality of lights arranged in substantially linear series, the plurality of lights being parallel to a horizontal edge of the housing base, the plurality of lights being placed in different illuminated states by the controller in response to the detecting one of an ARMED, DISARMED and TROUBLED conditions.

3. The security system of claim 2, further comprising:

a power cord engagable to a fixed power source for providing power to the controller and the lamp, the lamp movable by the controller into an illuminated condition in response to the controller receiving power only from the discrete power sources.

4. The security system of claim 3, further comprising:

a camera, mounted to the pyramid side, that will take pictures for displaying.

5. The security system of claim 1, further comprising:

a camera, mounted to the pyramid side, that will take pictures for displaying.

6. A security system, comprising:

a) at least one satellite unit coupled in signal communication to a main unit, the main unit further comprising a housing, the housing being substantially in the form of a pyramid with a base, and an apparatus for emitting an alerting stimulus in response to a signal received from the satellite unit indicating the presence of a security threat;

b) a detector, for detecting the presence of at least one security threat, located on the side of the pyramid, oriented in an approximately vertical position, forming an angle with the side of the pyramid upon which the detector is placed, the detector and the panic switch being located substantially on opposite location on the pyramid sides;

c) a cell phone docking station, mounted to the side of the pyramid, for recharging electrical energy to a cell phone;

d) a cell phone locking mechanism, located at the cell phone docking station, designed to lock the cell phone in place while being recharged; and e) a camera, mounted to the pyramid side, that will take pictures for displaying.

7. The security system of claim 6, further comprising:

a segmented light fixture including a plurality of lights arranged in substantially linear series, the plurality of lights being parallel to a horizontal edge of the housing base, the plurality of lights being placed in different illuminated states by the controller in response to the detecting one of an ARMED, DISARMED and TROUBLED conditions.

8. The security system of claim 7, further comprising:

a power cord engagable to a fixed power source for providing power to the controller and the lamp, the lamp movable by the controller into an illuminated condition in response to the controller receiving power only from the discrete power sources.

9. The security system of claim 8, further comprising:

at least one controller contained by the at least one satellite unit and the main unit.

10. The security system of claim 9, further comprising:

a lamp positioned on the at least one satellite unit and the main unit, such that there is no portion of the security system above the lamp obstructing the lamp's illumination.

11. The security system of claim 10, further comprising:

a discrete power source contained by the at least one satellite unit and the main unit for providing power to the controller and the lamp.

12. The security system of claim 11, further comprising:

a panic switch located on a side of the pyramid, for causing the apparatus to emit the alerting stimulus upon actuation of the panic switch.

* * * * *